US009482499B1

(12) United States Patent
Gotzmer et al.

(10) Patent No.: US 9,482,499 B1
(45) Date of Patent: Nov. 1, 2016

(54) EXPLOSIVELY FORMED PROJECTILE (EFP) WITH CAVITATION PIN

(71) Applicants: Carl Gotzmer, Accokeek, MD (US); Amos Dare, Cheltenham, MD (US); Steven Kim, Crofton, MD (US); Jeff St. Clair, White Plains, MD (US)

(72) Inventors: Carl Gotzmer, Accokeek, MD (US); Amos Dare, Cheltenham, MD (US); Steven Kim, Crofton, MD (US); Jeff St. Clair, White Plains, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 566 days.

(21) Appl. No.: 13/998,510

(22) Filed: Oct. 25, 2013

(51) Int. Cl.
*F42B 10/00* (2006.01)
*F42B 1/028* (2006.01)
*F42B 1/032* (2006.01)

(52) U.S. Cl.
CPC ..... *F42B 1/028* (2013.01); *F42B 1/032* (2013.01)

(58) Field of Classification Search
CPC ..... F42B 1/028; F42B 1/032
USPC ..... 102/306–310, 476; 89/1.15
See application file for complete search history.

(56) References Cited

U.S. PATENT DOCUMENTS 2,796,833 A * 6/1957 Sweetman ..... E21B 43/116 102/306
2,984,307 A * 5/1961 Barnes ..... E21B 49/04 102/307
3,021,784 A * 2/1962 Meddick ..... E21B 43/117 102/306
3,302,567 A * 2/1967 Venghiattis ..... E21B 43/117 102/306
4,034,673 A * 7/1977 Schneider, Jr. ..... F42B 12/10 102/476
4,080,898 A * 3/1978 Gieske ..... F42B 1/028 102/306
4,191,265 A * 3/1980 Bosse-Platiere ..... E21B 43/117 102/310

(Continued)

FOREIGN PATENT DOCUMENTS

DE 19 10 779 12/1977

OTHER PUBLICATIONS

Richard L. Summers and William P. Walters, The Behavior of Shaped Charges with Open-Poled Hemispherical Liners, Propellants, explosives, pyrotechnics, pp. 140-144.

(Continued)

*Primary Examiner* — Samir Abdosh
(74) *Attorney, Agent, or Firm* — Frederic J. Zimmerman

(57) ABSTRACT

The invention is an explosively formed projectile (EFP). On detonation of an explosive charge, an explosively formed projectile is formed from two separate metal elements, an open-poled dished liner and a cavitation pin. The open-poled dished liner is made of a metal more dense than a metal of the cavitation pin. The cavitation pin lies on the open-poled dished liner longitudinal axis and in contact therewith. The cavitation pin has a truncated right conical shape with a base diameter to length ratio of 0.7:1 to 1.5:1. The ratio of the open-poled dished liner diameter:cavitation pin fore portion major base diameter is 2:1 to 4:1. Upon detonation, the cavitation pin leads the explosively forged liner in the explosively formed projectile assembly. The leading pin causes cavitation in water resulting in an increase in the velocity of the explosively formed projectile.

16 Claims, 9 Drawing Sheets

(56) References Cited

U.S. PATENT DOCUMENTS 4,499,830 A * 2/1985 Majerus ..... F42B 1/032 102/307
4,841,864 A * 6/1989 Grace ..... F42B 1/02 102/307
5,155,297 A * 10/1992 Lindstadt ..... F42B 1/032 102/306
5,349,908 A * 9/1994 Walz ..... F42B 1/028 102/307
5,365,852 A * 11/1994 Bender ..... F42B 1/028 102/476
5,753,850 A * 5/1998 Chawla ..... F42B 1/02 102/307
6,167,811 B1 * 1/2001 Walters ..... F42B 1/02 102/307
6,305,289 B1 * 10/2001 Mayseless ..... F42B 1/028 102/307
6,510,796 B2 * 1/2003 Mayseless ..... F42B 1/028 102/307
8,375,859 B2 * 2/2013 Sagebiel ..... F42B 1/028 102/306
9,291,435 B2 * 3/2016 Scheid ..... F42B 1/02
9,335,132 B1 * 5/2016 Collier ..... F42B 1/032
9,360,222 B1 * 6/2016 Collier ..... F42B 1/028
2013/0104765 A1 * 5/2013 Stecher ..... F42B 1/032 102/476

OTHER PUBLICATIONS

R.L. Summers, W.P. Walters, R.D. Dick, The Behavior of Shaped Charges with Open-Poled Hemispherical Liners, Ballistic Research Laboratory, Aberdeen Proving Ground, Tech Rpt.

* cited by examiner

EXPLOSIVELY FORMED PROJECTILE (EFP) WITH CAVITATION PIN

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to a munition for use in marine environment. More particularly the invention relates to an explosively formed projectile (EFP). The invention also relates to a method of increasing range and velocity of an explosively formed projectile in water.

2. Discussion of the Related Art

An explosively formed projectile (EFP) is a type of munition that combines an explosive charge with a projectile forming work piece. The work piece is shaped by explosive forging into an elongated, solid projectile during explosive detonation. Besides an explosively formed projectile (EFP), other explosively formed projectiles include the shaped charge (SC) and the High Explosive Anti-Tank (HEAT) munition.

The essential element of a shaped charge (SC) is a liner that on firing forms an elongated hyper-velocity metal jet that is projected toward an armored target. The generally cone-shaped liner has a relatively small diameter and produces deep, relatively small diameter penetration of the target. Continuity of the elongated shaped charge (SC) jet breaks up with extended travel distance to the target. Break-up alters the shape of the jet; most significantly at target impact. Therefore it is necessary to reduce standoff distance to a length that allows an effective continuous jet to impact the target. In military applications, the shaped charge (SC) is often combined with a rocket to form a rocket propelled grenade (RPG) assembly. In a rocket propelled grenade (RPG) the rocket carries the shaped charge explosive munition to the target. The explosive charge is ignited on contact with the target and the projectile jet is formed inside the shaped munition housing. This arrangement results in a very short penetrator jet travel distance before impacting the target. Shaped charges (SC) have high impact velocities of about 3 to 4 kilometers/second.

A High Explosive Anti-Tank (HEAT) munition also relies on a cone-shaped liner that is explosively formed into a narrow, relatively long jet penetrator. Relatively more time is required for the formation of the penetrator jet. The shape of the cone liner and configuration of the explosive charge are adjusted for desired results. The HEAT munition requires sufficient standoff distance from the target to form before target impact. Therefore, it is necessary to increase standoff distance to a length that allows an effective jet to impact the target. A delivery mechanism ignites the explosive charge at a required distance from the target. A HEAT munition is usually contained in an anti-tank shell or missile. The velocity of the shell or missile and distance from the target are included in the time of ignition calculation of the delivery mechanism. HEAT penetrators have high impact velocities of about 10 to 15 kilometers/second.

An explosively formed projectile (EFP) is explosively forged from a dish-shaped metal work piece into a single, compact, relatively massive penetrator. The EFP is accelerated to a velocity of 1 to 3 kilometers/second which is less than the velocity of a shaped charge (SC) or High Explosive Anti-Tank (HEAT) projectile. The essential explosively formed projectile (EFP) munition includes a generally cylindrically-shaped case containing an explosive charge and a dish-shaped metal liner. The dished liner is positioned at a forward end of the case and an explosive charge initiator is positioned aft. EFP warheads are designed to produce a compact, high velocity penetrator. After detonation, the charge produces an explosive blast pressure that accelerates the liner and simultaneously reshapes the shallow dish-shaped liner by rearward folding into a compact, slug-shaped projectile. The compact slug is fundamentally distinguished from an elongated shaped charge (SC) jet or elongated HEAT jet. The EFP slug is able to traverse a relatively longer standoff distance before impacting the target, and deliver a relatively large diameter high mass projectile. The destructive potential of a penetrator is quantified by kinetic energy at impact. Kinetic energy is quantified as the product of the projectile mass and the square of the impact velocity. The EFP has an impact velocity in air in the range of about 1 to about 3 kilometers/second.

Explosively formed projectile (EFP) munitions have been developed and modified over time to facilitate penetration of armor targets. The several parameters in the munition configuration have been adjusted to achieve penetration of improved generations of ballistic armors. EFP modification investigations have been directed to penetrating land and air targets but not to targets in water. It has been thought that the formation of a slug projectile would be inhibited in a water environment. More specifically, water would cause a drag on the projectile and full potential velocities could not be achieved. Explosively formed projectiles (EFP) have been investigated with the objective of overcoming the adverse effects of water. However, the explosively formed projectile (EFP) has not achieved its potential in marine use.

There is a need in the naval ordnance arts for an explosively formed projectile (EFP) munition that performs effectively in water.

SUMMARY OF THE INVENTION

An explosively formed projectile (EFP) includes an open-poled dished liner and port plug assembly positioned symmetrically on a longitudinal axis and has a single port positioned on the longitudinal axis. The open-poled dished liner has a convex surface in contact with an explosive charge, and a concave surface in contact with an air space. The open-poled dished liner is made of a first metal of greater density.

The port plug is made of second metal of lesser density. The port plug is formed into a cavitation pin extending through the port, intersecting the open-poled dished liner. The unitary cavitation pin has a fore portion and an aft portion. The cavitation pin fore portion projects forward from open-poled dished liner concave surface along the longitudinal axis into the air space. The cavitation pin aft portion projects aft from the open-poled dished liner convex surface along the longitudinal axis into the explosive charge.

The cavitation pin fore portion has the shape of a truncated right cone with a major base having a major base diameter and minor base having a minor base diameter.

The cavitation pin aft portion has the shape of a right circular cone with a cone base having a cone base diameter. The major base of the frusto-conical shape is joined with the cone base to form the unitary cavitation pin at the port.

On ignition of the explosive charge, the cavitation pin leads the explosively formed open-poled dished liner projectile slug along the longitudinal axis. The cavitation pin causes cavitation in water, thereby increasing the velocity of the trailing explosively formed projectile (EFP) slug. As a result, higher velocity explosively formed projectile (EFP) slug is formed resulting in higher kinetic energy impacting of a target.

BRIEF DESCRIPTION OF THE DRAWING

A more complete appreciation of the invention and many of its attendant advantages will be readily appreciated as the same becomes better understood by reference to the following exemplary detailed description when considered in connection with the accompanying drawing wherein.

Figure 1:
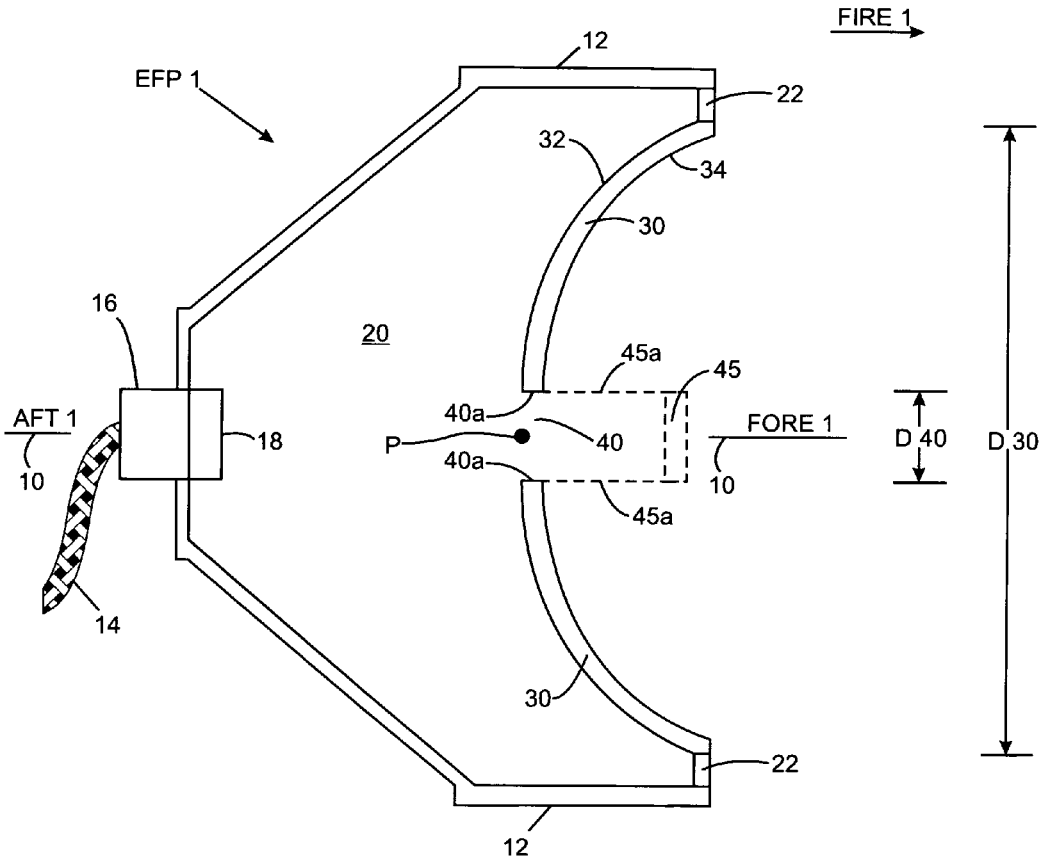
Prior Art FIG 1
FIG. 1 is an elevated side view showing a section of a conventional explosively formed projectile (EFP) including an open-ported dished liner according to the prior art with a port plug shown in phantom lines.

The invention is described with reference to the drawing wherein numerals in the written description correspond to like-numbered elements in the several figures. The drawing discloses an exemplary embodiment of the invention and is not intended to limit the generally broad scope of the invention as set forth in the claims.

DETAILED DESCRIPTION OF THE INVENTION

Attention is drawn to FIG. 1 showing a conventional explosively formed projectile munition EFP1 according to the prior art. The explosively formed projectile (EFP) is assembled with reference to a longitudinal axis 10 which is also ordinarily a nominal axis of rotation for most of the essential elements of the projectile. Longitudinal axis 10 is labeled fore (FORE1) and aft (AFT1) to indicate relative position of the elements of the projectile mounted along the longitudinal axis. Firing direction is indicated by arrow FIRE1. Arrow FIRE1 also indicates the direction in which the detonation wave (not shown) travels.

A projectile-forming explosive charge 20 comprises any of the explosive materials useful for this application. In general explosive materials are referred to in the art as either an ideal explosive or a non-ideal explosive. Ideal explosives rely on the chemical bonds between carbon, hydrogen, nitrogen and oxygen in the molecular structure for their explosive potential. By way of example, ideal explosives include LX-14, OCTOL, C-4, PBXN-110, Comp B, Pentolite, Amatex 40, TNT and any of the other ideal explosive that may be machined to fit snugly within cylindrical case 12 and against the convex surface 32 of dished explosive charge liner 30. Non-ideal explosives are distinguished from ideal explosives. Non-ideal explosives rely on mixing of explosive fuel and oxidizer for explosion to occur. Although less common for this application, non-ideal explosives have been used in explosively formed projectiles.

Electric cable 14 is attached to detonator 16 to transmit an electric charge to ignite intensifying charge 18. A relatively much smaller intensifying charge 18 is in direct contact with explosive charge 20 and made of an explosive material that is relatively more sensitive to ignition than explosive charge 20. Intensifying charged 18 provides the ignition to explosive charge 20 by exploding and forcing solid explosion debris into explosive charge 20.

Open-poled dished liner 30 is held in place on the longitudinal axis 10 by direct contact with explosive charge 20 and by toroidal support 22 that hold it in place relative to case 12. Open-poled dished liner 30 has a generally circular cross section with an axis of rotation coincident with longitudinal axis 10. Circular diameter D30 of open-poled dished liner 30 is measured perpendicular to longitudinal axis 10.

Open-poled dished liner 30 is positioned symmetrically on longitudinal axis 10 so that the apex is the aft-most point on the open-poled dished liner 30. The geometrical intersection of open-poled dished liner 30 and longitudinal axis 10 is at the apex, i.e. apical point P. Port 40 is circular and also centered on longitudinal axis 10 at the apical point P of open-poled dished liner 30. Port 40 is alternative referred to as a pole port or an apical port. The term "pole" is used with reference to the longitudinal axis. The term "apical" is used with reference to position on the apex or aft-most point of the open-poled dished liner 30. Port 40 is referred to in the art as the "open pole" or "pole port" and the dished liner referred to as an "open-poled dished liner." Port 40 is bounded by surface 40*a* of dished liner 30 and has a diameter D40.

Pole plug 45 is shown in phantom lines. Pole plug 45 also has a circular diameter that allows it to fit into port 40 in circumferential contact with surface 40*a* to completely fill apical port 40. Phantom lines 45*a* in FIG. 1 show that pole plug 45 fits directly into port 40. The fit is firm so that pole plug 45 is retained in place. Dished liner 30 is referred to as "open-poled" with or without the presence of pole plug 45.

In an equivalent configuration, dished liner 30 has a diameter approximately equal to the inside diameter of case 12. In this equivalent configuration, toroidal support 22 is not present. Clips (not shown) replace toroidal support 22 to attach dished liner 30 to case 12 and hold position relative to longitudinal axis 10. After ignition, explosive forces scatter any clips or toroidal support 22 as insignificant debris.

Figure 2A:
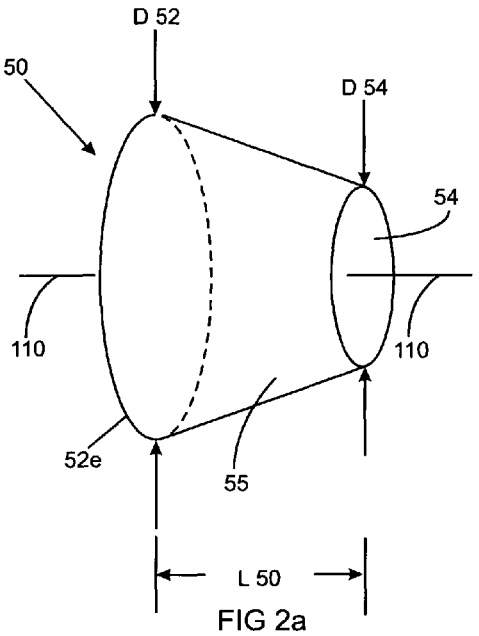
FIGS. 2*a* and 2*b* are perspective views showing defining surfaces of a right circular truncated cone.
Figure 2B:
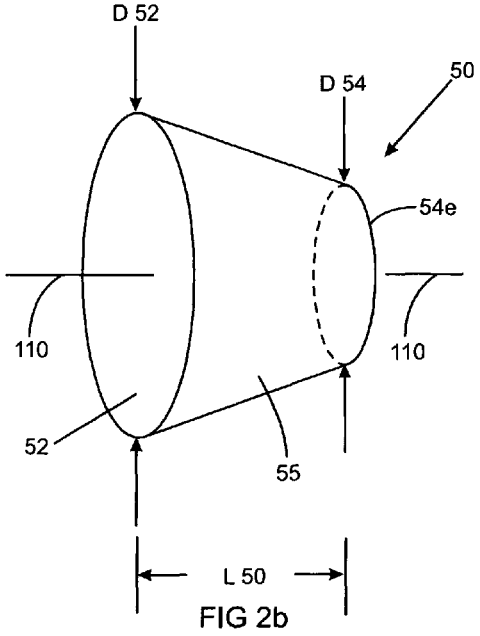

Reference is made to FIGS. 2*a*, 2*b*, 2*c* and 2*d* which show solid geometric shapes used to assemble cavitation pins of the invention. FIGS. 2*a* and 2*b* show two views of truncated right circular cone 50. In the alternative, a truncated right circular cone is referred to as a frustum. In a frustum the diameter of the major base is greater than the diameter of the minor base. The major base and minor base are flat. Flat means uniformly continuously perpendicular to the longitudinal axis. In FIGS. 2*a* and 2*b*, major base 52 has a major base diameter D52. Minor base 54 has a minor base diameter D54. The major base diameter D52 is greater than the minor base diameter D52. The axis of rotation of truncated right circular cone 50 is coincident with longitudinal axis 110. Side wall 55 extends between major base 52 and minor base 54. Truncated cone length L50 is measured along the longitudinal axis 10. The major and minor bases are flat, perpendicular to the longitudinal axis and have sharp edges 52*e*, 54*e*.

Figure 2C:
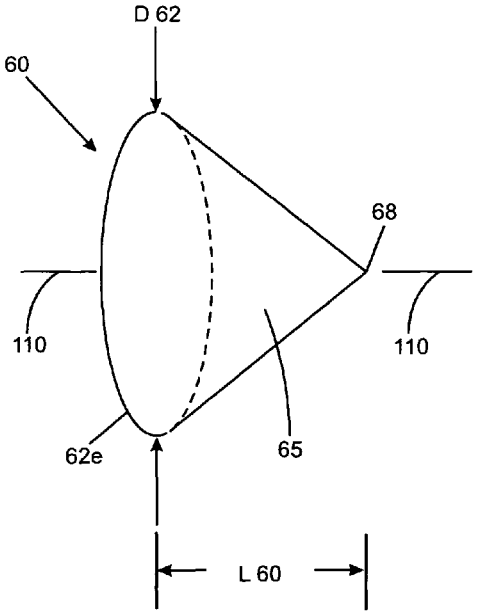
FIGS. 2*c* and 2*d* are perspective views showing defining surfaces of a right circular cone.
Figure 2D:
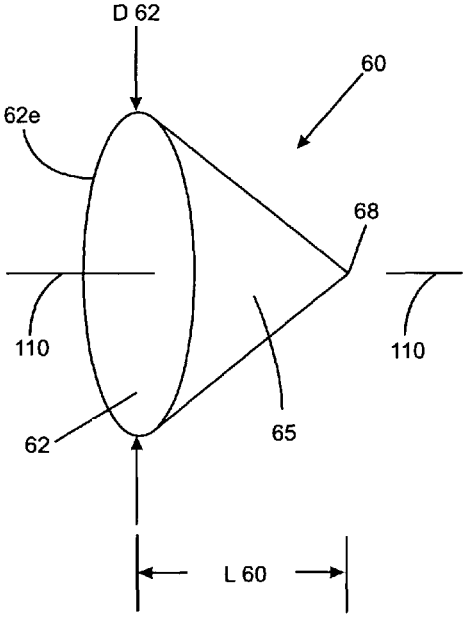

Reference is made to FIGS. 2*c* and 2*d* which show two views of right cylindrical cone 60. A right circular cone extends from a base to an apex. The base is circular in shape and flat. Flat means uniformly continuously perpendicular to the longitudinal axis. In FIGS. 2*c* and 2*d*, cone base 62 has a cone base diameter D62. The axis of rotation of truncated right circular cone 60 is coincident with longitudinal cone axis 110. Also shown is side wall 65 extending from cone base 62 to cone' apex 68. Cone length L60 is measured along the longitudinal axis 110 from cone base 62 to apex 68. The cone base is flat, perpendicular to the longitudinal axis and has a sharp circular edge 62*e*.

In one exemplary embodiment of the invention, a cavitation pin is formed by joining a right circular cone 60 (as indicated in FIGS. 2*c* and 2*d*) with a truncated right circular cone 50 (as indicated in FIGS. 2*a* and 2*b*). This configuration is accomplished by joining major base 52 of the truncated cone 50 with cone base 62 of the right circular cone 60. In this configuration, the two diameters, D52 and D62, are of equal magnitude. The longitudinal axis for the two geometric solids is coincident.

In another exemplary embodiment of the invention, a cavitation pin is formed by joining a truncated right circular cone 50 (as indicated in FIGS. 2*a* and 2*b*) with another truncated right circular cone 50 (as indicated in FIGS. 2*a* and 2*b*). This configuration is accomplished by joining minor base 54 of the one truncated cone 50 with the minor base 54 of the other truncated cone 50. In this configuration, the two diameters D54 are of equal magnitude. The longitudinal axis for the two geometric solids is coincident.

First Exemplary Embodiment

Figure 3A:
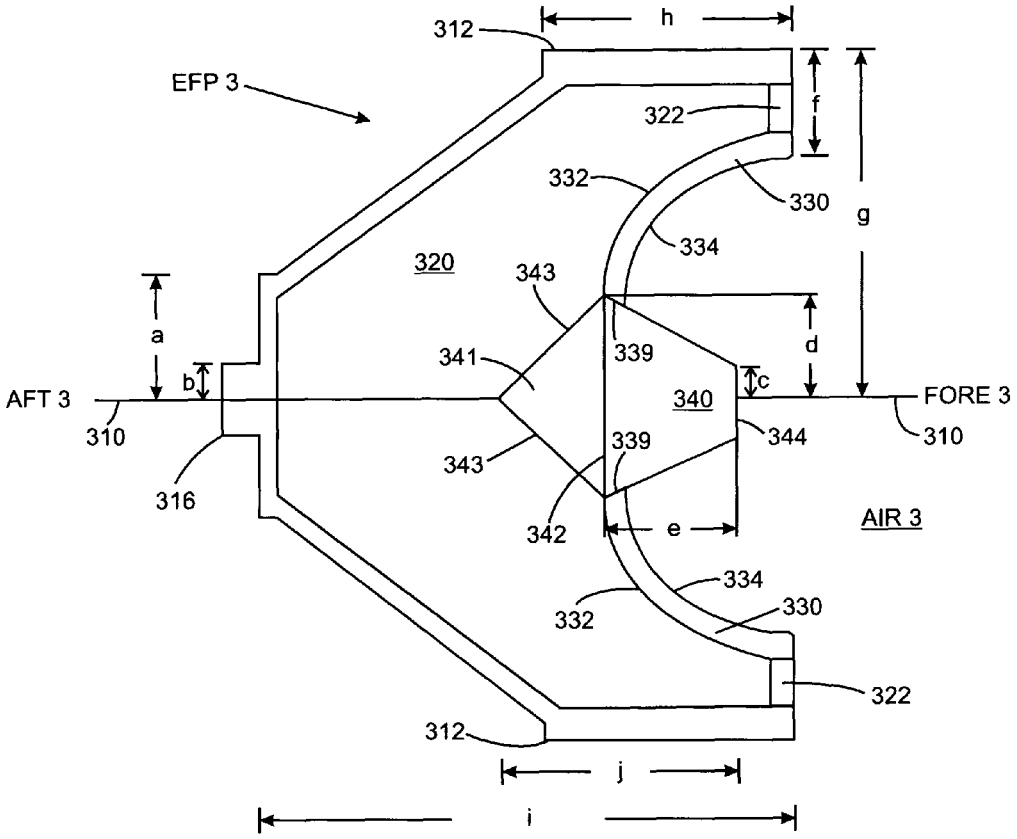
FIG. 3*a* is a schematic sectional side view of an explosively formed projectile with cavitation pin showing dimensions.

FIG. 3*a* is a sectional side view of an explosively formed projectile munition EFP3 according to the invention constructed on longitudinal axis 310. Longitudinal axis 310 is labeled fore (FORE3) and aft (AFT3). This fore and aft orientation also applies to the orientation of all the elements included in munition EFP3. High explosive charge is labeled 320. Open-poled dished liner is labeled 330. Cavitation pin 340,341 fills an apical port in open-poled dished liner 330. The apical port is indicated by surface 339 on open-poled dished liner 330. Circular surface 339 is the outer boundary of the circular, apical port. Cavitation pin 340,341 is formed of a metal, which is less dense than the metal of construction of the open-poled dished liner 330. HERE Cavitation pin 340,341 is formed by joining cavitation pin fore portion 340 with cavitation pin aft portion 341. Cavitation pin fore portion 340 has a right circular truncated cone shape. Cavitation pin aft portion 341 has a cone shape. Cavitation pin fore portion 340 and cavitation pin aft portion 341 are joined along surface 342. Surface 342 is both the major base of cavitation pin fore portion 340 and the cone base of cavitation pin aft portion 341 coincide at surface 342. Surface 342 is flat and perpendicular to longitudinal axis 310. Cavitation pin fore portion 340 and cavitation pin aft portion 341 are formed as single, unitary cavitation member 340,341. Cavitation pin aft portion 341 has side wall surface 343 in contact with explosive charge 320. Cavitation pin fore portion 340 with minor base 344 is in contact with airspace AIR3. Convex surface 332 is in contact with explosive charge 320. Concave surface 334 is in contact with AIR3.

The remaining elements shown in FIG. 3*a* conform to like elements in FIG. 1 and are identified as follows: case 312; detonator 316; and toroidal support 322.

Second Exemplary Embodiment

Figure 4A:
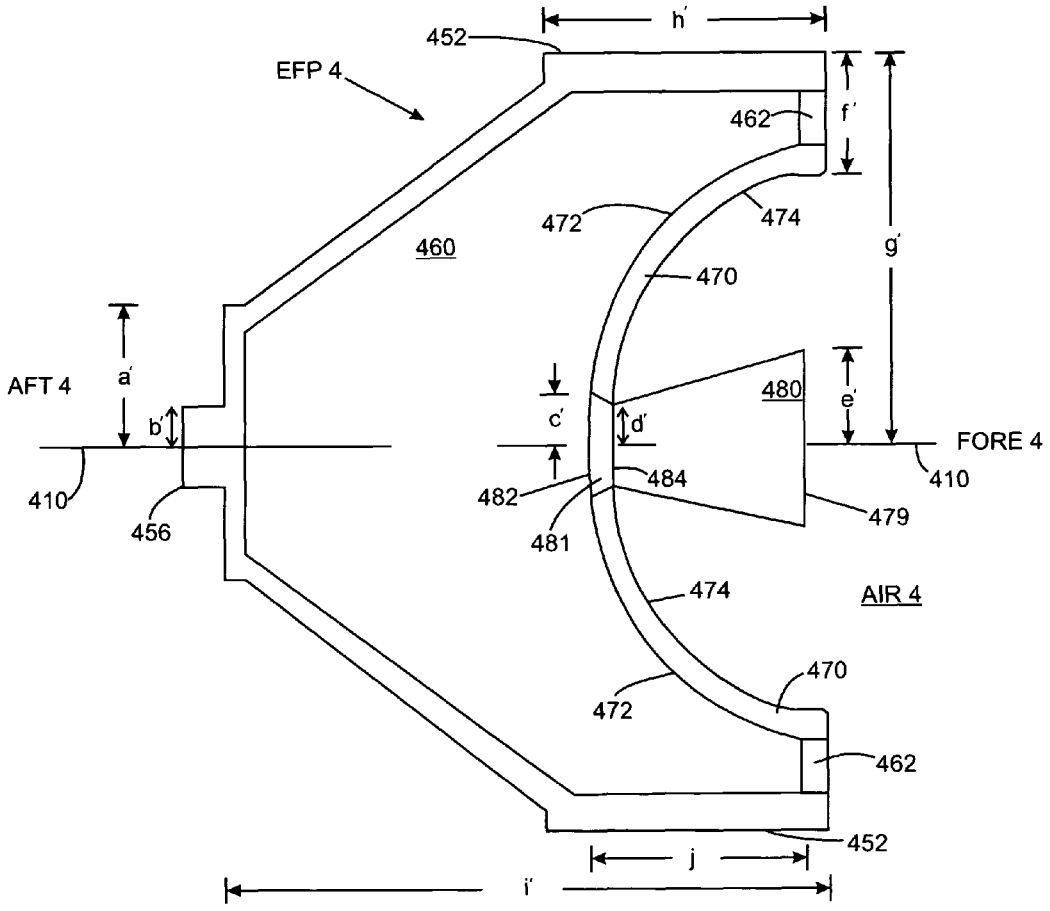
FIG. 4*a* is a schematic sectional side view of an explosively formed projectile with alternate cavitation pin showing dimensions.

FIG. 4*a* is a sectional side view of an explosively formed projectile munition EFP4 according to the invention constructed on longitudinal axis 410. Longitudinal axis 410 is labeled fore (FORE4) and aft (AFT4). This fore and aft orientation is also the fore and aft orientation for all the elements included in munition EFP4. High explosive charge is labeled 460. Open-poled dished liner is labeled 470. Cavitation pin fore portion 480 with major base 479 is in contact with airspace AIR4. A cavitation pin aft portion is labeled 481. Cavitation pin fore portion 480 and cavitation aft portion 481 join at surface 484 to form cavitation pin 480,481. Cavitation pin fore portion 480 and cavitation pin aft portion 481 are formed as a single, unitary cavitation pin 480,481. Cavitation pin fore portion 480 has the shape of a truncated right circular cone. Cavitation pin aft portion 481 also has the shape of a truncated right circular cone. The two truncated right circular cones are joined at the respective minor bases as indicated in FIG. 4*a* by surface 484. Cavitation pin aft portion 481 includes a major base surface 482 in contact with explosive charge 460.

The remaining elements shown in FIG. 4*a* conform to like elements in FIG. 1 and are identified as follows: case 452; detonator 456; toroidal support 462; convex surface 472; and concave surface 474

In an explosively formed projectile (EFP), a cylindrical charge made of an explosive material is ignited to collapse, symmetrically, a dish-shaped liner metal material on itself in an air cavity. The air cavity is geometrically defined by a concave face of the dish-shaped liner. A cavitation pin lies on and along a longitudinal axis of the liner. The cavitation pin is made of a metal of lesser density than the dish-shaped liner metal. The explosively collapsing liner metal material is forged radially inwardly toward the longitudinal axis, and simultaneously propelled longitudinally outwardly with the cavitation pin along the longitudinal axis in the direction of the detonation wave, which is caused by detonated explosive material. This explosive forging and propelling generates a high velocity, solid projectile with the lesser density cavitation pin material fore and the greater density liner material aft along the longitudinal axis.

In operation, an air space fills the cavity on the fore side of the open-poled dished liner and extends outward from it to the munition housing. The cavitation pin fore portion is retained before firing in contact with this air space. An explosively-modified solid projectile is formed from the cavitation pin followed by a slug forged from the liner during the brief passage of the metal materials through the air space. The lesser density explosively-modified cavitation pin leads the greater density collapsed compact liner along the longitudinal axis. Since they are traveling at the same velocity, position of the two differing explosively-modified solids is not significantly altered relative to each other as they move together along the longitudinal axis. In particular, the lesser density cavitation pin material remains the fore edge of the projectile combination throughout the entire flight, that is, through the air cavity and through the water, to the target. Geometric shape of the fore, less dense cavitation pin causes water to cavitate. The greater density collapsed compact liner, i.e. the slug, follows closely, benefiting from the cavitation caused by the pin. The benefit is a higher velocity for the slug projectile than could have otherwise been achieved in water.

First, on ignition, potential energy in the explosive material is transferred to a detonation wave. Second, energy from the detonation wave is transferred to the compact mass of collapsing liner material and cavitation pin. The collapsed liner slug, which is formed, has a kinetic energy quantified by the product of the mass and the squared velocity of the compact solid mass.

The character of the damage that a projectile imparts to a target is related to the diameter and mass of the projectile as well as the projectile velocity squared at impact. Mass is related to continuity of the explosively formed projectile. An explosively formed projectile (EFP) slug is a compact, i.e. highly continuous, relatively massive projectile. The mass has a high kinetic energy at impact in comparison to a shaped charge (SC) jet or a HEAT projectile jet. Additional characteristics of target damage relate to physical parameters of the target itself, such as, armoring, and are not addressed here.

The present invention increases kinetic energy of the projectile in water at target impact by an amount equal to the square of the increase in velocity. The result is a more efficient transfer of kinetic energy to the target and increased target penetration and damage. The magnitude of the penetration damage perpendicular to the longitudinal axis is determined by selection of liner mass and diameter, which is known in the art.

Figure 5:
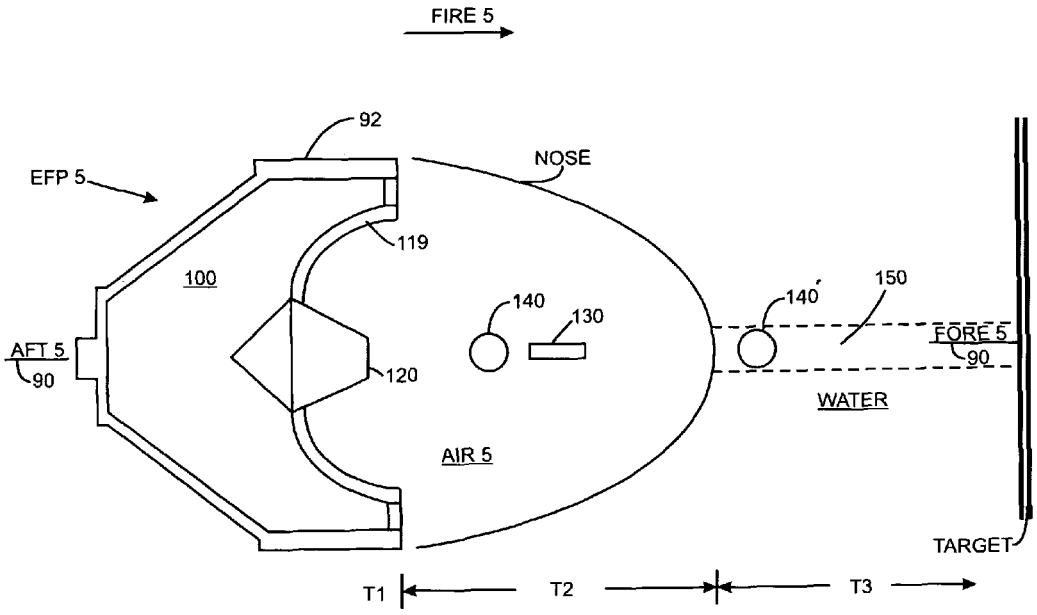
FIG. 5 is a side elevation and schematic time lapse sequence of events of an explosively formed projectile munition firing in water.

FIG. 5 shows a side elevation and schematic time lapse sequence of events of a munition including the explosively formed projectile of the invention firing in air and traversing water. There are three events in the time lapse sequence each identified by time: first time period T1, second time period T2 and third time period T3.

First time period T1 is the event prior to firing the explosively formed projectile EFP5. The explosively formed projectile munition EFP5 is constructed with reference to a longitudinal axis 90, which is also ordinarily an axis of rotation for the essential elements of the munition. Longitudinal axis 90 is labeled aft (AFT5) to the left and fore (FORE5) to the right to provide reference for the orientation of the elements of the projectile on the axis. Firing direction is indicated by arrow FIRE5. FIRE5 is also the direction in which a detonation wave (not shown) travels.

A projectile-forming explosive charge 100 includes any of the explosive materials listed above for explosive charge 20. Explosive charge 100 fits within cylindrical case 92 and against open-poled dished charge liner 119. Cavitation pin 120 is attached to open-poled dished charge liner 119 in air space AIR5 filling the space between open-poled dished charge liner 119 and the hydrodynamic nose cone NOSE of munition EFP5. The munition EFP5 is aimed and fired at target (TARGET) by conventional procedures.

In second time period T2, explosively formed projectile munition EFP5 is fired by igniting explosive charge 100, causing the explosive formation of the cavitation pin 120 to be modified into explosively modified pin 130 moving generally along longitudinal axis 90 in the direction indicated by arrow FIRE5. It is essential that explosively modified pin 130 be formed in air space AIR5 to achieve a compact continuous solid that is, the fore edge of the entire projectile is formed. The projectile should not be formed in water. Simultaneously, charge liner 119 is collapsed and explosively formed into a slug projectile 140. Slug projectile 140 is also propelled along longitudinal axis 90 in the general direction indicated by arrow FIRE5. During second time period T2, the cavitation pin 120 forms explosively modified pin 130, and charge liner 119 forms slug projectile 140. Explosively modified pin 130 leads while slug projectile 140 follows along longitudinal axis 90 in the direction indicated by arrow FIRE5. The second time period T2 event takes place in the air space AIR5.

In third time period T3, an explosively modified pin 130 leaves air space AIR5 and enters WATER. In water, explosively modified pin 130 causes cavitation track 150 along the longitudinal axis 90 up to a TARGET. The closely following slug projectile 140' also enters WATER. However, slug projectile 140' receives the benefit of traversing the distance to the TARGET in the cavitation track 150 caused by the fore explosively modified pin 130. The velocity of slug projectile 140' is measurably increased. As a result, the kinetic energy of slug projectile 140' at impact with TARGET is increased causing increased penetration and damage of TARGET.

It has been found that velocity of an explosively formed projectile (EFP) may be increased in water by carefully constraining the explosively formed projectile (EFP) to certain well defined physical parameters.

There are four physical parameters. First, it is essential to attach a cavitation pin to the open-poled dished charge liner on the longitudinal axis, i.e. the nominal axis of rotation, of both the cavitation pin and the open-poled dished liner. The cavitation pin should intersect the open-poled dished liner. In the intersection, a major portion of the mass of cavitation pin must lie on the concave side of the liner with a minor portion in contact with the explosive charge.

Regarding the second parameter, it is essential that the cavitation pin is made of a metal, which is less dense than the metal of which the charge liner is formed. Metals of particular interest are aluminum, zirconium, copper, titanium, lithium, silver, magnesium, molybdenum, tantalum, manganese, tin, iron, nickel, zinc, boron, and silicon. An exemplary combination is an aluminum cavitation pin and a copper open-poled dished charge liner.

Regarding the third parameter, it is essential that the truncated right cone-shaped cavitation pin has an aspect ratio of the cavitation pin major base diameter:cavitation pin length, which ranges from about 0.7:1 to about 1.5:1. In an exemplary embodiment, the aspect ratio is dependent on orientation of the cavitation pin on the longitudinal axis, and more particularly, in an exemplary embodiment, the aspect ratio is about 1:1.

Regarding the fourth parameter, it is essential that the truncated right cone-shaped cavitation pin has a diameter ratio of the shaped charge liner diameter:the cavitation pin fore portion major base diameter, which ranges from about 2:1 to about 4:1.

In theory, the invention relies on cavitation and supercavitation to increase velocity of a projectile in water. Cavitation occurs within water when the water pressure is reduced to below the vapor pressure. The result is a vapor bubble within the liquid volume. The cavitation pin is explosively formed into an elongated, solid metal penetrator. The elongated penetrator is laterally streamlined with a sharp edged, flat leading surface. Importantly, the flat leading surface deflects water radially outward as it travels. This motion creates a pressure drop, particularly following the aft surface. The sharp edge of the flat leading and trailing surfaces enhance the pressure drop. The result is a vapor track following the cavitation pin.

The charge liner is explosively formed into a compact slug. The compact slug follows the cavitation pin closely in the vapor track. The leading and following positions are maintained.

The cavitation pin and charge liner dimensions are selected so that the cavitation pin forms a vapor track of sufficient diameter where the compact slug travels entirely within the vapor track. The selected dimensions are the aspect ratio of the pin major base diameter:cavitation pin length, and the diameter ratio of the shaped charge liner diameter:cavitation pin major base diameter. Accordingly, as the compact slug travels in the vapor track it essentially avoids contact with liquid water. This phenomenon is referred to as super-cavitation. The result of super-cavitation is an increase in velocity due to reduced frictional drag. Kinetic energy of the slug penetrator is thereby increased.

The mechanism of the invention has been confirmed by computer simulation.

This invention is shown by way of Example.

Actual Example 1

FIG. 4*a* is a sectional side view of an explosively formed projectile munition EFP5 according to the invention constructed on longitudinal axis 510. Longitudinal axis 510 is labeled fore (FORE5) and aft (AFT5).

The following dimensions were used to construct a simulated model of the munition.

TABLE 1

| Dimension | Length |
|---|---|
| a | 3.241 centimeters |
| b | 0.986 |
| c | 1.028 |
| d | 2.421 |
| e | 3.748 |
| f | 2.257 |
| g | 9.160 |
| h | 6.435 |
| i | 14.820 |
| j | 6.500 |

The ratio of Mass of High Explosive/(Mass of Cu liner+Al pin) was about 1.25. The cavitation pin fore portion has a greater volume than the aft portion. The cavitation pin fore portion has a greater length measured along the longitudinal axis than the aft portion.

The munition was dynamically simulated by computer modeling. A time sequence of events was recorded as follows:

1. The munition was positioned in an air space above water before firing, time=0.0 milliseconds.
2. The fired munition traversed the air space and impacted the surface of the water, time=0.5 milliseconds.
3. The munition traversed 2 meters of water with super-cavitation, time=2.0 milliseconds.
4. The munition achieved ultimate penetration of 30.7 feet and was stopped by the water, time=30.5 milliseconds.

Figure 3B:
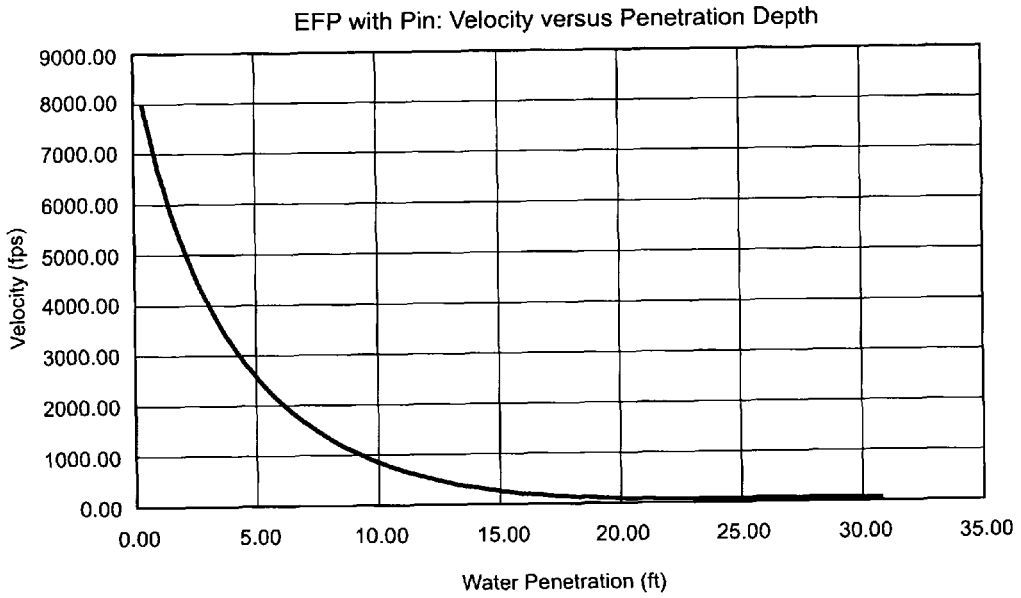
FIG. 3*b* is a plot of velocity data versus penetration in water for the projectile with cavitation pin shown in FIG. 3*a* and described in Example 1.

FIG. 3*b* is a plot of data from the dynamic computer simulation showing EFP4 munition penetration velocity versus water penetration. Initial munition velocity was about 8000 feet/second. The projectile was stopped after traversing 30.7 feet of water.

Actual Example 2

FIG. 4*a* is a sectional side view of an explosively formed projectile munition EFP4 according to the invention constructed on longitudinal axis 410. Longitudinal axis 410 is labeled fore (FORE4) and aft (AFT4). This fore and aft orientation is also the fore and aft orientation for all the elements included in munition EFP4.

The following dimensions were used to construct a simulated model of the munition.

TABLE 2

| Dimension | Length |
|---|---|
| a' | 3.241 centimeters |
| b' | 0.986 |
| c' | 2.421 |
| d' | 2.120 |
| e' | 3.180 |
| f' | 2.257 |
| g' | 9.160 |
| h' | 6.435 |
| i' | 14.820 |
| j' | 5.220 |

The ratio of Mass of High Explosive/(Mass of Cu liner+Al pin) was approximately 1.25. The cavitation pin fore portion has a greater volume than the aft portion. The cavitation pin fore portion has a greater length measured along the longitudinal axis than the aft portion.

The munition was dynamically simulated on computer. A time sequence of events was recorded as follows:

1. The munition was positioned in an air space above water before firing, time=0.0 milliseconds.
2. The fired munition traversed the air space and impacted the surface of the water, time=0.5 milliseconds.
3. The munition traversed 1.35 meters of water with super-cavitation, time=2.0 milliseconds.
4. The munition achieved ultimate penetration of 14.25 feet and was stopped by the water. Super-cavitation diameter was 6.7 inches, time=7.4 milliseconds.

Figure 4B:
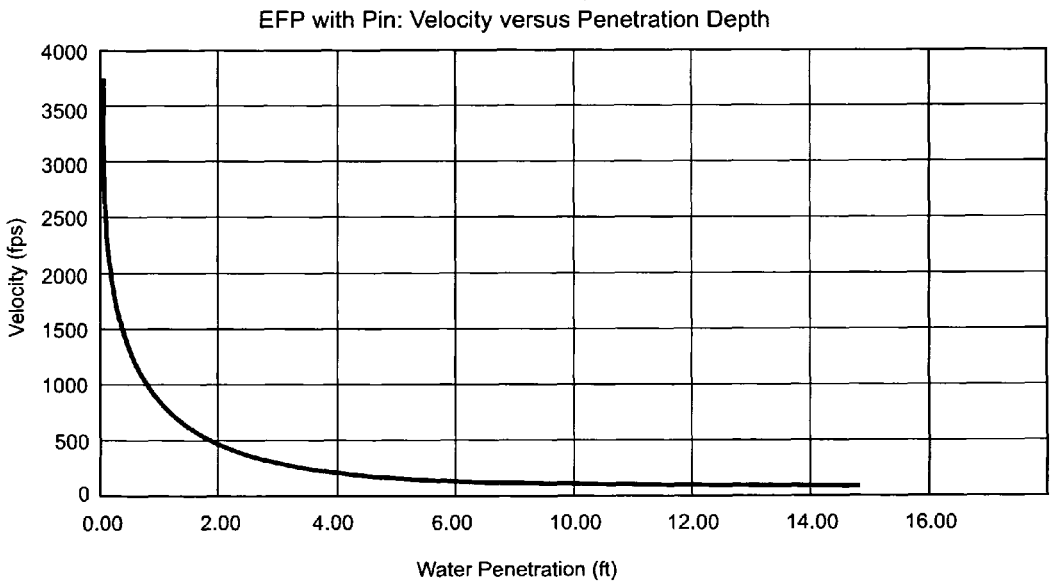
FIG. 4*b* is a plot of velocity data versus penetration for the projectile with alternate cavitation pin shown in FIG. 4*a* and described in Example 2.

FIG. 4*b* is a plot of data from the dynamic simulation showing EFP4 munition penetration velocity versus water penetration. Initial munition velocity was about 3750 feet/second. The projectile was stopped after traversing 4.5 feet of water.

Actual Example 3

Comparative

Performance of a shaped charge (SC) or an explosively formed projectile (EPF) is measured by target penetration. The charge liner is explosively formed into a penetrator projectile and travels a standoff distance to the target. It then penetrates the target and travels a penetration distance into the target until its kinetic energy is expended.

Figure 6:
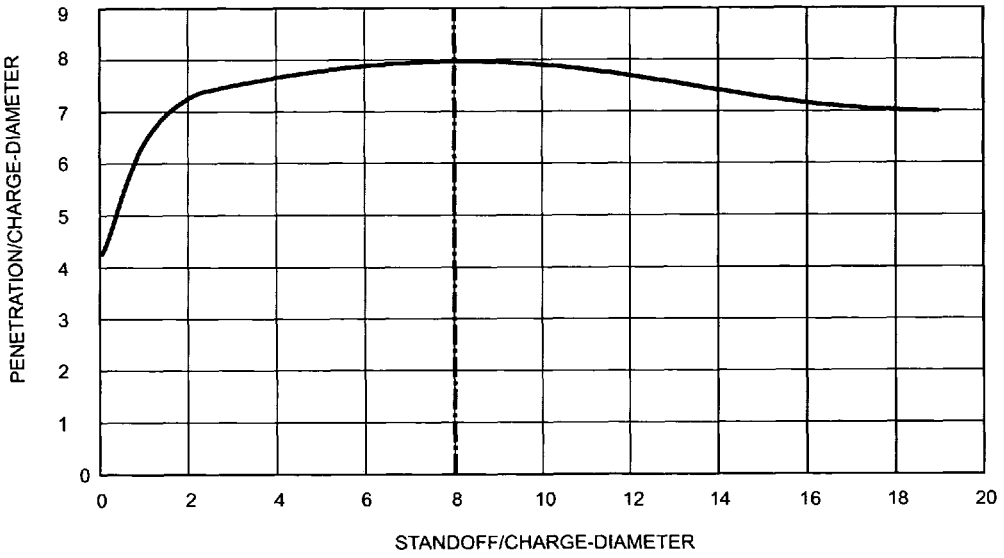
FIG. 6 is a Penetration-Standoff Curve from a simulation of a conical shaped (SC) charge liner projectile formed in water.

A shaped charge (SC) penetrator was simulated using a well-known simulation program. Optimum standoff distance for a conical shaped charge penetrator into water was calculated. The results are shown in FIG. 6. It was found that the optimum standoff distance for a conical shaped charge was about 8 charge-diameters.

Actual Example 4

Comparative

An explosively formed projectile (EFP) stretches the metal liner to form a single, unitary projectile. Water interferes with shaping/forging the projectile and causes rapid erosion and slowing on penetration. As a result penetration and standoff distance are greatly reduced by formation of the projectile in water.

Figure 7:
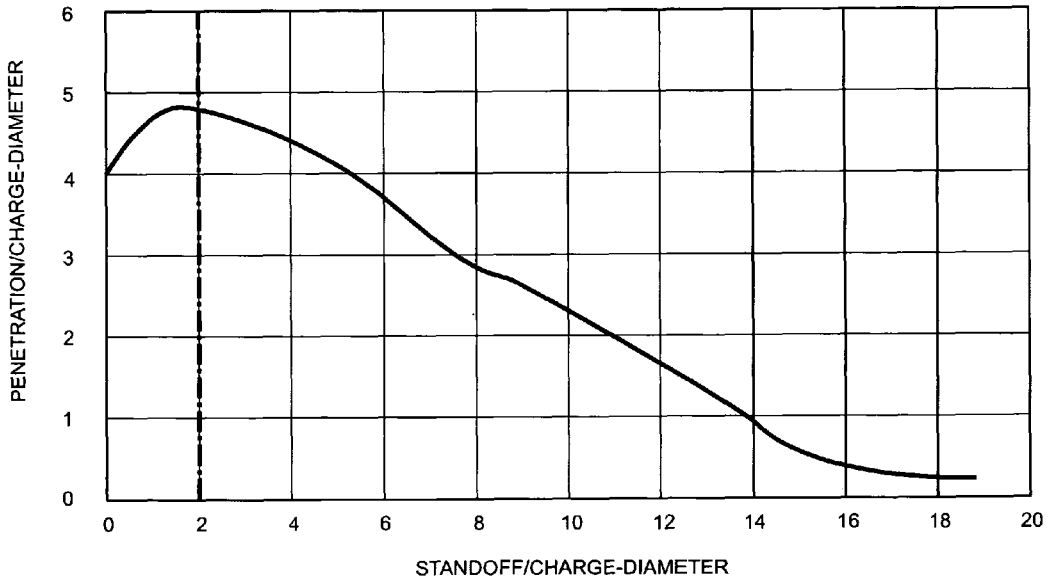
FIG. 7 is a Penetration-Standoff Curve from a simulation of an explosively formed projectile (EPF) formed in water.

An explosively formed projectile (EFP) was simulated using the same well-known simulation program used in Example 3. The results are shown in FIG. 7. The simulation showed that the optimum standoff distance for an explosively formed projectile (EFP) in water was about 2 charge-diameters.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A shaped charge munition of the type including a generally cylindrical case filled with an explosive charge and having a longitudinal axis, comprising:

a forward end of the cylindrical case being capped with an open-poled dished liner and port plug, wherein the open-poled dished liner includes a concave surface in contact with an air space and a convex surface in contact with the explosive charge, wherein the open-poled dished liner includes a port positioned on the longitudinal axis, wherein the open-poled dished liner is comprised of a first metal with a first density wherein the port plug includes a unitary cavitation pin to fill the port and intersect the open-poled dished liner, wherein the cavitation pin is comprised of a second metal with a second density, which is less than the first density, wherein the cavitation pin is comprised of a fore portion, an aft portion, and a major base of a right frusto-conical shape, wherein the fore portion extends from the port in the open-poled dished liner, along the longitudinal axis into the air space, wherein the fore portion is comprised of the right frusto-conical shape with a minor base of first diameter and the major base with a second diameter, which is greater diameter than the first diameter, wherein the aft portion extends from the apical port in the open-poled dished liner, along the longitudinal axis into the explosive charge, wherein the aft portion is comprised of a right conical shape with a cone base, and wherein the major base of the right frusto-conical shape of the fore portion is joined at the port with the cone base of the aft portion to form the unitary cavitation pin.

2. The shaped charge munition of claim 1, wherein the fore portion is of greater volume than the aft portion.

3. The shaped charge munition of claim 1, wherein the pin fore portion has a greater length measured along the longitudinal axis than the aft portion.

4. The shaped charge munition of claim 1, wherein the cavitation pin is made of aluminum, and wherein the open-poled dished charge liner is made of copper.

5. The shaped charge munition of claim 1, wherein an aspect ratio of cavitation pin right frusto-conical major base diameter:a length of the cavitation pin is in a range from about 0.7:1 to about 1.5:1.

6. The shaped charge munition of claim 5, wherein the aspect ratio of the cavitation pin right frusto-conical major base diameter:the length of the cavitation pin is about 1:1.

7. The shaped charge munition of claim 1, wherein an aspect ratio of open-poled dished liner diameter:cavitation pin fore portion major base diameter is in a range from about 2:1 to about 4:1.

8. A shaped charge munition of the type including a generally cylindrical case filled with an explosive charge and having a longitudinal axis, comprising:

a forward end of the cylindrical case being capped with an open-poled dished liner and a port plug assembly, wherein the open-poled dished liner includes a concave surface in contact with an air space and a convex surface in contact with the explosive charge, wherein the open-poled dished liner includes a port positioned on the longitudinal axis, wherein the open-poled dished liner is comprised of a first metal with a first density wherein the port plug includes a unitary cavitation pin to fill the port and intersect the open-poled dished liner, wherein the cavitation pin is comprised of a second metal with a second density, which is less than the first density, wherein the cavitation pin is comprised of a fore portion, an aft portion, and a first minor base of a first right frusto-conical shape, wherein the fore portion extends from the concave surface of the open-poled dished liner, along the longitudinal axis into the air space, wherein the fore portion is comprised of the first right frusto-conical shape with the first minor base with a first diameter and a first major base with a second diameter, which is greater than the first diameter, wherein the aft portion extends from the convex surface of the open-poled dished liner, along the longitudinal axis and in contact with the explosive charge, wherein the aft portion includes a second right frusto-conical shape with a second minor base with a third diameter and a second major base with a fourth diameter, which is greater than the third diameter, wherein the first minor base of the first right frusto-conical shape is joined to the second minor base of the second right frusto-conical shape at the port to form the unitary cavitation pin.

9. The shaped charge munition of claim 8, wherein the fore portion is of greater volume than the aft portion.

10. The shaped charge munition of claim 8, wherein the fore portion includes a greater length measured along the longitudinal axis than the aft portion.

11. The shaped charge munition of claim 8, wherein the cavitation pin is made of aluminum, and wherein the open-poled dished liner is made of copper.

12. The shaped charge munition of claim 8; wherein an aspect ratio of cavitation pin right frusto-conical major base diameter:a length of the cavitation pin is in a range from about 0.7:1 to about 1.5:1.

13. The shaped charge munition of claim 8, wherein an aspect ratio of cavitation pin right frusto-conical major base diameter:a length of the cavitation pin is about 1:1.

14. The shaped charge munition of claim 8, wherein an aspect ratio of open-poled dished liner diameter:cavitation pin fore portion major base diameter is in a range from about 2:1 to about 4:1.

15. A method of increasing range and velocity in water of an explosively formed projectile (EFP), comprising:

positioning an open-poled dished charge liner on an EFP longitudinal axis, wherein the open-poled dished charge liner is made of a first metal of a first density, and wherein the open-poled dish charge liner includes a convex surface in contact with an explosive charge, a concave surface in contact with an air space, and a port positioned on the EFP longitudinal axis;

extending a unitary cavitation pin through an open in the port, and intersecting the open-poled dished charge liner, wherein the unitary cavitation pin is made of a second metal with a second density, which is less dense than the first density of lesser density, wherein the cavitation pin projects from the concave surface along the EFP longitudinal axis, wherein the cavitation pin includes a fore portion and an aft portion, wherein the fore portion projects from the concave surface along the longitudinal axis into the air space, wherein the fore portion includes a sharp-edge circular leading surface perpendicular to the longitudinal axis, wherein the aft portion projects from the convex surface along the longitudinal axis in contact with the explosive charge, and wherein the aft portion includes a sharp-edge circular aft surface perpendicular to the longitudinal axis;

aligning the EFP longitudinal axis in water with a target;

igniting the explosive charge, explosively forming the open-poled dished charge liner into an explosively formed projectile (EFP) and propelling it though the water; and cavitating water ahead of the explosively formed projectile and increasing the velocity in water.

16. The method of claim 15, wherein the cavitation pin is made of aluminum and wherein the open-poled dished charge liner is made of copper.

* * * * *